US009447608B2

(12) United States Patent
Clifford et al.

(10) Patent No.: US 9,447,608 B2
(45) Date of Patent: Sep. 20, 2016

(54) LOCKING CARTRIDGES

(71) Applicant: Schlage Lock Company LLC, Indianapolis, IN (US)

(72) Inventors: Jason Curtis Clifford, Colorado Springs, CO (US); Evan Earl Evans, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 149 days.

(21) Appl. No.: 14/525,870

(22) Filed: Oct. 28, 2014

(65) Prior Publication Data

US 2016/0115711 A1 Apr. 28, 2016

(51) Int. Cl.

| | |
|---|---|
| ***E05B 29/02*** | (2006.01) |
| ***E05B 29/00*** | (2006.01) |
| ***E05B 27/00*** | (2006.01) |
| ***E05B 21/06*** | (2006.01) |
| ***E05B 31/00*** | (2006.01) |

(52) U.S. Cl.

CPC ..... *E05B 29/0013* (2013.01); *E05B 21/066* (2013.01); *E05B 27/0003* (2013.01); *E05B 29/0066* (2013.01); *E05B 31/00* (2013.01)

(58) Field of Classification Search

CPC ..... E05B 21/00; E05B 21/06; E05B 21/063; E05B 21/066; E05B 27/0003; E05B 27/0017; E05B 27/0021; E05B 2027/0025; E05B 29/00; E05B 29/0013; E05B 29/0033; E05B 29/004; E05B 29/0053; E05B 29/006; E05B 29/0066; E05B 31/00

See application file for complete search history.

(56) References Cited

U.S. PATENT DOCUMENTS

| | | | | |
|---|---|---|---|---|
| 1,869,426 | A * | 8/1932 | Jacobi | E05B 29/00 70/360 |
| 2,155,440 | A * | 4/1939 | Olson | E05B 29/00 70/358 |
| 3,581,534 | A * | 6/1971 | Testa | E05B 29/04 70/375 |
| 3,808,854 | A * | 5/1974 | Mercurio | E05B 15/1614 70/375 |
| 3,972,210 | A * | 8/1976 | Toivonen | E05B 29/0013 70/366 |
| 4,015,458 | A | 4/1977 | Mercurio | |
| 4,180,999 | A * | 1/1980 | Hurskainen | E05B 21/006 70/366 |
| 4,370,875 | A | 2/1983 | Piiroinen | |
| 4,686,843 | A * | 8/1987 | Martikainen | E05B 21/066 70/366 |
| 4,729,231 | A | 3/1988 | Wu | |
| 5,168,734 | A | 12/1992 | Duval et al. | |

(Continued)

FOREIGN PATENT DOCUMENTS

DE 19544740 A1 6/1997

*Primary Examiner* — Christopher Boswell

(74) *Attorney, Agent, or Firm* — Taft Stettinius & Hollister LLP

(57) ABSTRACT

A locking cartridge including a housing, first and second plates rotatably mounted in the housing, a blocking member, and a movable member. The cartridge also includes a cam interface which urges the first plate toward the second plate when the plates are rotated. The blocking member is configured to move among a blocking position and an unblocking position in response to engagement with a first cut on a key. When in the blocking position, the blocking member blocks the first plate from moving toward the second plate. With the second plate blocked from moving toward the first plate, the cam interface prevents rotation of the first plate. The movable member is configured to move among a first position and a second position in response to engagement with a second cut on the key. In certain embodiments, the movable member may be a control pin or a second blocking member.

20 Claims, 15 Drawing Sheets

(56) References Cited

U.S. PATENT DOCUMENTS 5,687,594 A 11/1997 Wang
5,715,717 A 2/1998 Widen
5,964,107 A 10/1999 Chang
6,826,936 B1 * 12/2004 Ming-Er ..... E05B 29/0013 70/353
9,027,373 B2 * 5/2015 Zuraski ..... E05B 29/0013 70/358
2015/0114056 A1 * 4/2015 Liao ..... E05B 19/0035 70/344
2015/0152666 A1 * 6/2015 Ho ..... E05B 29/0013 70/353

* cited by examiner

LOCKING CARTRIDGES

TECHNICAL FIELD

The present invention generally relates to modular locking cartridges, and more particularly but not exclusively to lock cylinders including such cartridges.

BACKGROUND

Lock cylinders, particularly those of the interchangeable core variety, have complex part tolerances and pinning to allow the cylinder to function properly. The complexities can also make the pinning process difficult and laborious. If pinning is off, the entire assembly may need to be emptied and reset. Furthermore, many traditional interchangeable core assemblies suffer from a tendency to "explode" when the plug is removed from the shell. That is to say, the springs eject the internal components out of the assembly, thereby losing the pinning placement and running the risk of damaging, destroying, or losing one or more components. Therefore, a need remains for further improvements in lock cylinder assemblies.

SUMMARY

An exemplary locking cartridge includes a housing, first and second plates rotatably mounted in the housing, a blocking member, and a movable member. The cartridge also includes a cam interface which urges the first plate toward the second plate when the plates are rotated. The blocking member is configured to move among a blocking position and an unblocking position in response to engagement with a first cut on a key. When in the blocking position, the blocking member prevents the first plate from moving toward the second plate. When in the unblocking position, the blocking member does not prevent the first plate from moving toward the second plate. With the second plate blocked from moving toward the first plate, the cam interface prevents rotation of the first plate in the first rotational direction. The movable member is configured to move among a first position and a second position in response to engagement with a second cut on the key. In certain embodiments, the movable member may be a control pin or a second blocking member. Further embodiments, forms, features, and aspects of the present application shall become apparent from the description and figures provided herewith.

DETAILED DESCRIPTION OF ILLUSTRATIVE EMBODIMENTS

Figure 1:
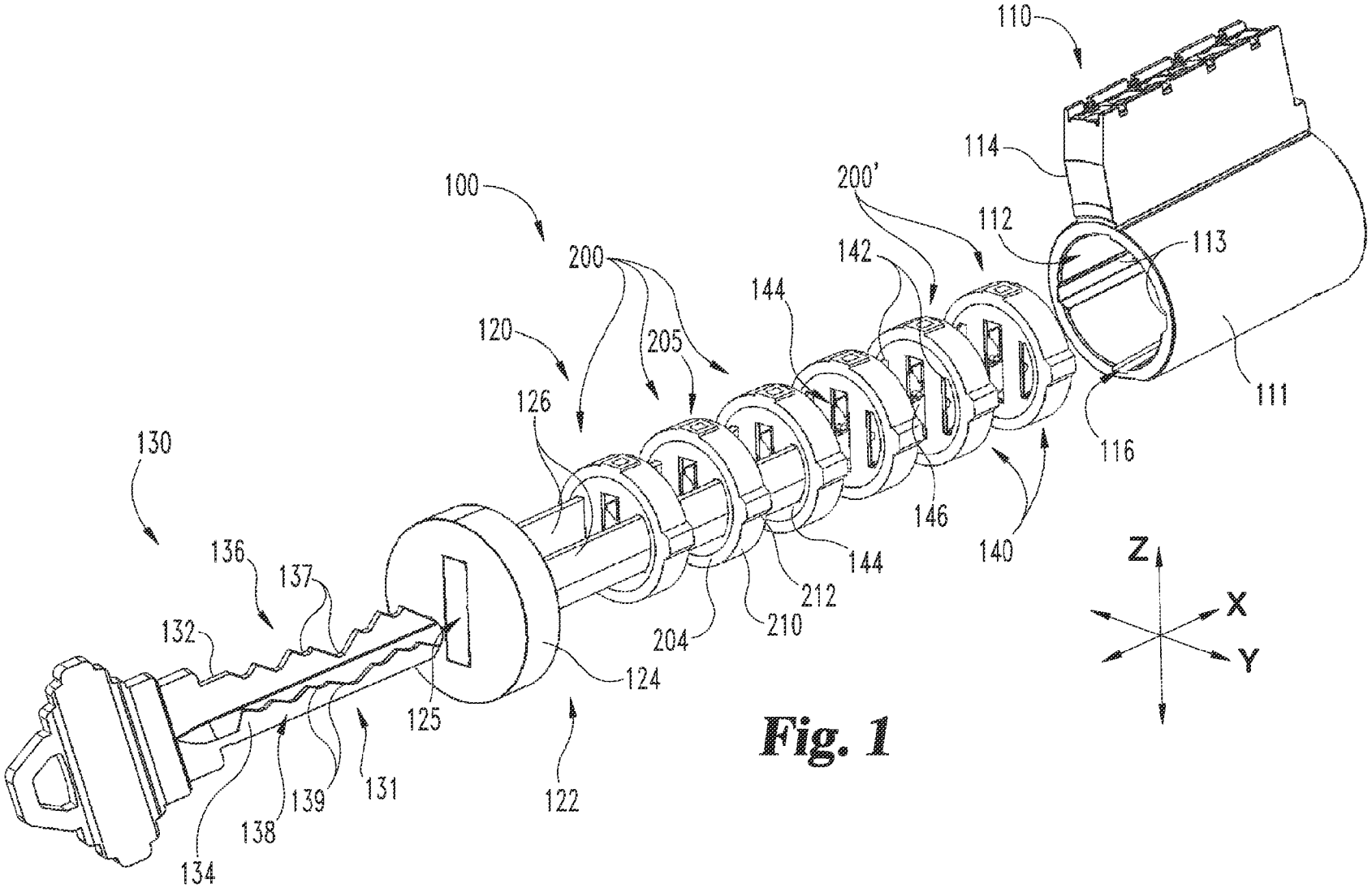
FIG. 1 is an exploded assembly view of a lock cylinder according to one embodiment.
Figure 2:
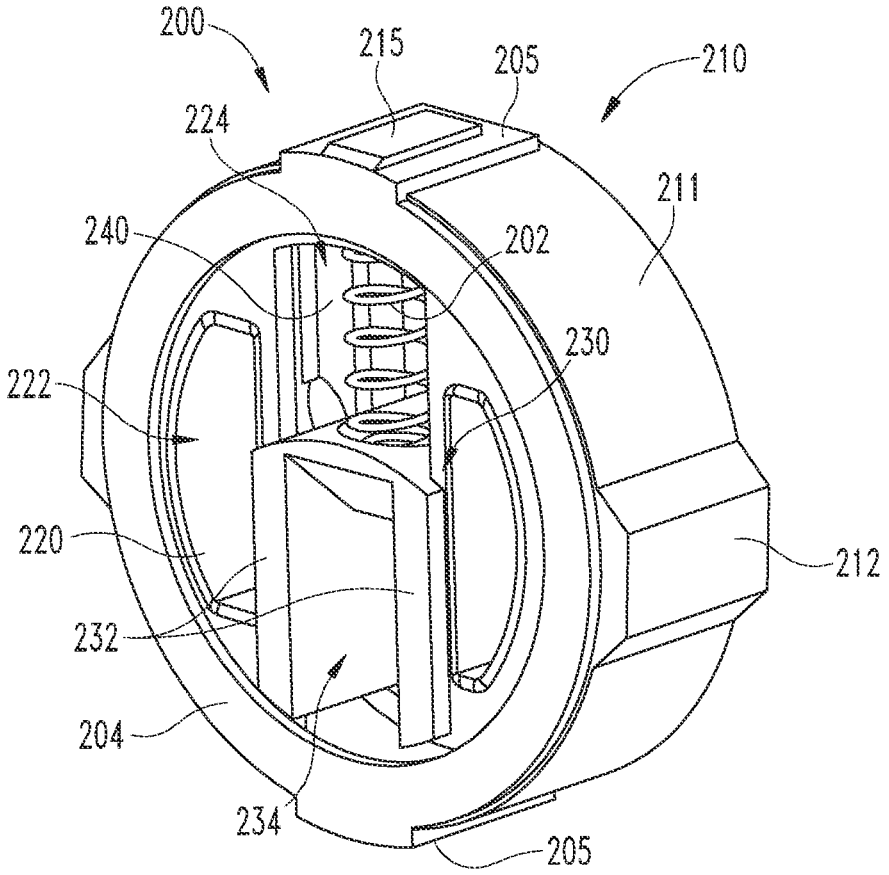
FIG. 2 is a side perspective view of a first side of a cartridge according to one embodiment.
Figure 3:
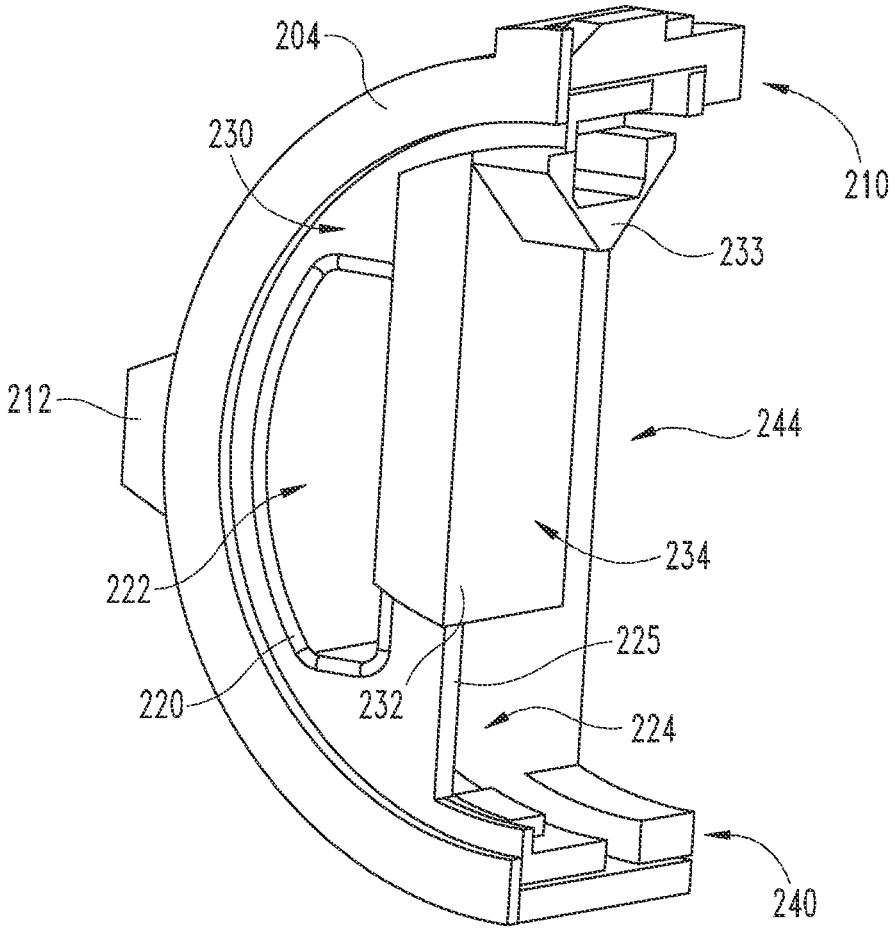
FIG. 3 is a first cutaway view of the cartridge illustrated in FIG. 2.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal", "lateral", and "transverse" are used to denote motion or spacing along or substantially along three mutually perpendicular axes. In the coordinate plane illustrated in FIG. 1, the X-axis defines the longitudinal directions (including a proximal direction and a distal direction), the Y-axis defines the lateral directions, and the Z-axis defines the transverse directions. These terms are used for ease of convenience and description, and are without regard to the orientation of the system with respect to the environment. For example, descriptions that reference a longitudinal direction may be equally applicable to a vertical direction, a horizontal direction, or an off-axis orientation with respect to the environment. The terms are therefore not to be construed as limiting the scope of the subject matter described herein.

With reference to FIG. 1, an illustrative lock cylinder 100 includes a shell 110 and a plug 120, and is operable by a key 130. As described in further detail below, the plug 120 includes a plurality of modular cartridges 140. One or more of the cartridges 140 may, for example, be of the type disclosed in commonly-owned U.S. patent application Ser. No. 14/296,308 to Clifford et al., the contents of which are incorporated herein by reference in their entirety.

The shell 110 includes a body portion 111 defining a chamber 112 in which the plug 120 is positioned, and may further include a tower 114 configured to allow the cylinder 100 to be installed into an existing cylinder housing (not shown). In the illustrated embodiment, the tower 114 is configured such that the cylinder 100 is a key-in-lever type lock cylinder. However, it is also contemplated that the shell 110 may be configured such that the cylinder 100 is of another configuration or format, such as, for example, small format interchangeable core, full size, large format, mortise, and/or rim. Additionally, in certain embodiments, the tower 114 may be omitted.

The plug 120 is disposed within the chamber 112 and comprises a plug body 122 and a plurality of cartridges 140.

The plug body 122 comprises a faceplate 124 including a passage 125 and a pair of posts 126. The posts 126 extend distally from the faceplate 124 and through the passages 142 formed in the cartridges 140. The plug 120 may be formed by stacking the cartridges 140 on the plug body 122 such that passages 144 formed in the cartridges 140 are aligned with the faceplate passage 125, thereby defining a keyway configured to receive the key 130. The plug 120 may further comprise a tailpiece (not illustrated) rotationally coupled to the plug body 122 so as to transfer rotation of the plug body 122 to a deadbolt or another form of a locking element. One or more of the cartridges 140 may be a cartridge 200 of the type described below, while others may be another type of cartridge 200'.

The key 130 includes a shank 131 having a tip 132, an edge 133, and a side surface 134. The key 130 includes a first cut 136 comprising a plurality of first bitting features 137, and may further comprise a second cut 138 comprising a plurality of second bitting features 139. Each of the cuts 136, 138 comprises a key code defined by the size and position of the bitting features 137, 139. In the illustrated form, the first cut 136 is formed along the edge 133, and the second cut 138 is formed along the side surface 134. The illustrated first cut 136 is of the type commonly known as an "edge cut", and the first bitting features 137 are edge-cut bittings. Additionally, the illustrated second cut 138 is of the type commonly known as a "side-milling", and the second bitting features 139 are side-milled bittings.

While the exemplary key 130 includes an edge cut 136 and a side-milling 138, it is also contemplated that additional or alternative types of cuts may be utilized. For example, the side surface 134 may instead include a dimple cut comprising a key code defined by the lateral depth (i.e., along the illustrated Y-axis) of a plurality of dimple bitting features. In other embodiments, the second side surface and/or the second edge of the key 130 may include a key cut. Additionally, the key 130 need not necessarily include a cut formed along the edge 133 or a cut formed along the first side surface 134.

With additional reference to FIGS. 2-5, a cartridge 200 according to one embodiment comprises a housing 210, a stop plate 220, a sliding blocking member 230, and a cam plate 240. As described in further detail below, the stop plate 220 and the cam plate 240 are rotatably mounted in the housing 210, and the housing 210 is configured to urge the cam plate 240 toward the stop plate 220 in response to rotation of the cam plate 240. Additionally, the blocking member 230 has a blocking position which prevents rotation of the plates 220, 240, and an unblocking position which does not prevent rotation of the plates 220, 240. The blocking member 230 may be biased toward the blocking position by a spring 202, and is configured to move to the unblocking position when engaged by an appropriate bitting feature of a key.

The illustrative housing 210 comprises a substantially cylindrical body 211 and a pair of ridges 212 which provide the housing 210 with a non-circular outer perimeter. The shell 110 includes a pair of correspondingly-shaped channels 113 (FIG. 1) which provide the chamber 112 with a geometry corresponding to that of the housing 210. When assembled, the ridges 212 are received in the channels 113 such that the housing 210 is rotationally coupled to the shell 110. In other embodiments, ridges may instead be formed in the shell 110, and correspondingly-shaped grooves may be formed on the housing 210.

The stop plate 220 and the cam plate 240 are rotatably mounted in the housing 210, and a retaining ring 204 may be included to retain the plates 220, 240 within the housing 210. In the illustrated embodiment, the retaining ring 204 is releasably coupled to the housing 210 by a pair of collars 205 which engage protrusions 215 formed on the housing 210. It is also contemplated that the retaining ring 204 may be releasably coupled to the housing 210 in another manner, and/or that the retaining ring 204 may be fixedly coupled to the housing 210. In certain embodiments, the retaining ring 204 may be considered to form a portion of the housing 210.

While the illustrated housings 210 are rotationally coupled with the shell 110 by engagement of the ridges 212 with the channels 113, other forms of rotational coupling are also contemplated. In certain forms, the housing 210 may be rotationally coupled to the shell 110 via engagement between the collars 205 and grooves 116 formed in the shell 110, and the ridges 212 and channels 113 may be omitted. Additionally, other non-circular geometries may be utilized to rotationally couple the housing 210 to the shell 110. For example, the housing 210 may include more or fewer ridges 212, and/or the periphery of the housing 210 may have a polygonal geometry. Furthermore, while the illustrated chamber 112 has a geometry corresponding to that of the housing 210, it is also contemplated that other forms of engagement features may be utilized. For example, both the housing 210 and the shell 110 may include a channel, and the housing 210 may be coupled to the shell 110 by a spline seated in the channels. Furthermore, the housings 210 may be rotationally coupled with one another. For example, the housings 210 may include sets of mating protrusions and recesses which, when the cartridges 200 are stacked, rotationally couple each housing 210 to that of an adjacent cartridge 200.

The stop plate 220 is rotatably mounted in the housing 210 and includes a pair of openings 222 configured to receive the posts 126. Similarly, the cam plate 240 is rotatably mounted in the housing 210 and includes a pair of openings 242 aligned with the openings 222, thereby forming the passages 142. With the cartridges 200 stacked on the plug body 122, the posts 126 extend longitudinally through the passages 142, thereby rotationally coupling the plates 220, 240 with one another and with the plug body 122. The stop plate 220 and the cam plate 240 also include slots 224, 244, each of which is configured to receive the blocking member 230.

In the illustrated embodiment, each of the plates 220, 240 includes two openings 222, 242 corresponding to the two posts 126 of the plug body 122. However, it is also contemplated that more or fewer posts 126 may be utilized, and that the plates 220, 240 may include a corresponding number of openings. It is further contemplated that the plates 220, 240 may be coupled to the plug body 122 in another manner and/or to one another in another manner. In certain embodiments, the plates 220, 240 of the cartridges need not be rotationally coupled with one another. In such embodiments, the cartridges 200 may simply be stacked in the chamber 112.

The blocking member 230 is slidingly mounted on the stop plate 220 and is disposed partially within the slot 224. The blocking member 230 includes a pair of legs 232 and an engagement surface 233. The legs 232 are laterally offset from one another by a distance corresponding to the width of the key 130 such that a passage 234 is formed therebetween. While the illustrated blocking member 230 includes two legs 232, in other forms the blocking member 230 include only one leg 232 which may be slidingly coupled to an edge 225 of the slot 224. The cartridge 200 may also include a spring 202 urging the blocking member 230 toward the blocking position. When no key is inserted into the keyway, the legs 232 may be urged into contact with a surface of the cartridge 200 opposite the spring 202. The passage 234 is configured to receive the shank 131 of the key 130, and the engagement surface 233 is configured to travel along the edge cut 136 as the shank 131 is inserted. The engagement surface 233 may be tapered or curved to facilitate such travel. The opposing forces provided by the spring 202 and the shank 131 ensure that the position of the blocking member 230 corresponds to the root depth of the shank 131 at the point of contact.

In the illustrated embodiment, the engagement surface 233 is configured to engage the edge-cut bitting features 137. In other embodiments, the blocking member 230 may be configured to engage another type of key cut, such as the side-milling 138. For example, one of the legs 232 may include a lateral protrusion extending into the passage 234 and configured to travel along the side-milled bitting features 139.

Figure 4:
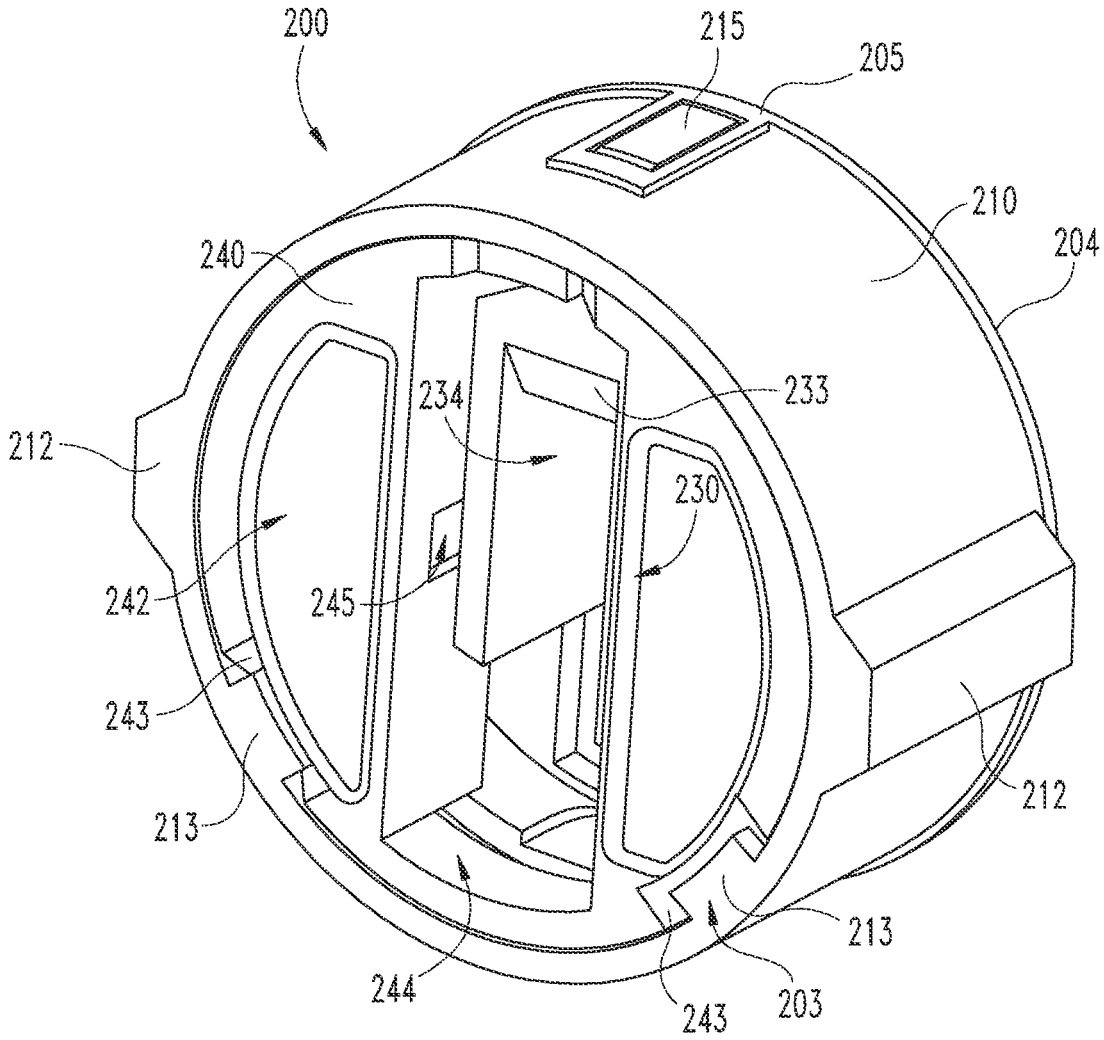
FIG. 4 is a perspective view of the second side of the cartridge illustrated in FIG. 2.
Figure 5:
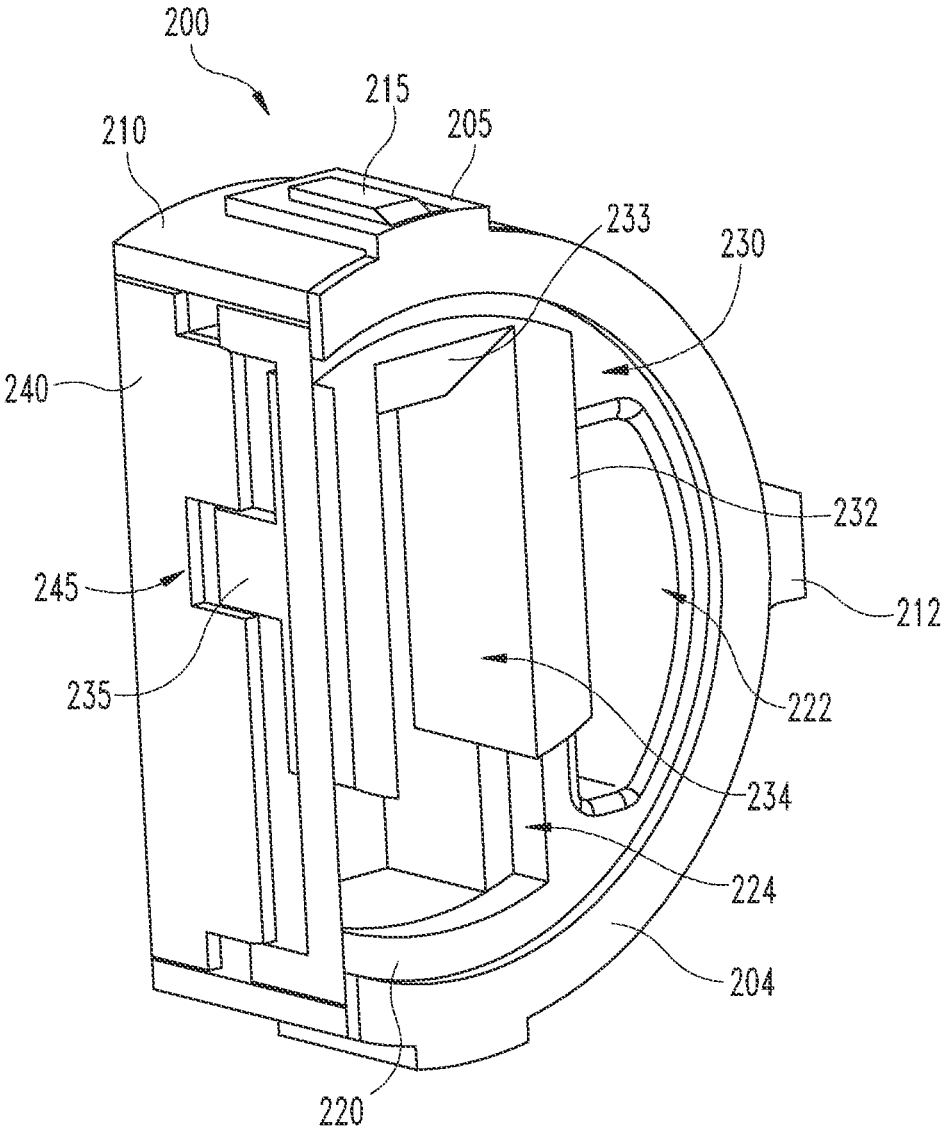
FIG. 5 is a second cutaway view of the cartridge illustrated in FIG. 2.

With specific reference to FIGS. 4 and 5, the housing 210 includes a set of first cam surfaces in the form of tapered protrusions 213, and the cam plate 240 includes a set of second cam surfaces in the form of tapered recesses 243. The tapered protrusions 213 and the tapered recesses 243 are engaged with one another, thereby forming a cam interface 203 which longitudinally urges the cam plate 240 toward the stop plate 220 when the cam plate 240 is rotated. In other words, rotation of the cam plate 240 with respect to the housing 210 causes the cam plate 240 to cam axially inward toward the stop plate 220. The cartridge 200 may further include a biasing member (not illustrated) urging the cam plate 240 toward an angular position in which the tapered protrusions 213 are received within the corresponding tapered recesses 243.

In the illustrated embodiment, the cam surfaces on the housing 210 are tapered protrusions 213, and the cam surfaces on the cam plate 240 are tapered recesses 243. However, in other embodiments, the cam plate 240 may include one or more tapered protrusions, and the housing 210 may include correspondingly-shaped recesses. Furthermore, while the illustrated cam surfaces are both tapered in a substantially rectilinear manner, it is also contemplated that one or more of the cam surfaces may have a different geometry so long as the interaction of the cam surfaces urges the cam plate 240 toward the stop plate 220 when the cam plate 240 is rotated. By way of non-limiting example, one or more of the cam surfaces may include a curvilinear geometry. It is also contemplated that the cam surfaces may be formed on the retaining ring 204 in addition to or in lieu of cam surfaces formed on the housing 210. In such embodiments, the retaining ring 204 may be positioned on the same side of the cartridge 200 as the cam plate 240.

While the illustrated cartridge 200 includes one stop plate 220 and one cam plate 240, it is also contemplated that the cartridge 200 may include two cam plates 240. In such embodiments, both the retaining ring 204 and the housing 210 may include cam surfaces such as the tapered protrusions 213. The cam surfaces formed by the retaining ring 204 may interact with the first cam plate, and the cam surfaces formed by the housing 210 may interact with the second cam plate, whereby the cam plates cam axially inward toward one another when rotated.

With specific reference to FIG. 5, the blocking member 230 includes an interference protrusion 235, and the cam plate 240 includes a correspondingly-shaped recess 245 configured to receive the interference protrusion 235. The blocking member 230 is movable among a blocking position in which the interference protrusion 235 is not aligned with the recess 245, and an unblocking position in which the interference protrusion 235 is aligned with the recess 245. The blocking member 230 is biased toward the blocking position via the spring 202, and is configured to move to the unblocking position when engaged with a proper edge-cut bitting feature 137. While the illustrated locking member 230 moves transversely (i.e., in the illustrated Z-direction) among the blocking and unblocking positions, it is also contemplated that a cartridge may include a blocking member which moves among the blocking and unblocking positions in another manner, in other directions, and along other axes of travel. Illustrative examples of such cartridges are described below with reference to FIGS. 6-11.

If the plates 220, 240 are rotated while the blocking member 230 is in the blocking position, the cam plate 240 comes into contact with the interference protrusion 235, which in turn prevents further longitudinal displacement of the cam plate 240. With longitudinal displacement of the cam plate 240 prevented, interference between the tapered protrusions 213 and the tapered recesses 243 prevents further rotation of the cam plate 240, thereby defining a blocked state of the cartridge 200. If the plates 220, 240 are rotated while the blocking member 230 is in the unblocking position, the cam plate 240 is free to move toward the stop plate 220 as the interference protrusion 235 enters the recess 245. The cam plate 240 is thus free to continue rotating, thereby defining an unblocked state of the cartridge 200.

In the exemplary cartridge 200, the cam plate 240 includes a single recess 245, and the cam plate 240 is rotatable with respect to the housing 210 at a single position of the blocking member 230. However, it is also contemplated that the cam plate 240 may include two or more of the recesses 245. In such cartridges 200, the cam plate 240 is rotatable with respect to the housing 210 at a number of positions of the blocking member 230 corresponding to the number of recesses 245.

In the illustrated embodiment, the interference protrusion 235 is formed on the blocking member 230, and the recess 245 is formed on the cam plate 240. However, in other embodiments, the cam plate 240 may include the protrusion, and the blocking member 230 may include the correspondingly-shaped recess. Furthermore, while the blocking member 230 is slidingly coupled to the stop plate 220, it is also contemplated that the blocking member 230 may be slidingly coupled to the cam plate 240. In such embodiments, the interference protrusion 235 may be formed on one of the blocking member 230 and the stop plate 220, and the correspondingly-shaped recess 245 may be formed on the other of the blocking member 230 and the stop plate 220.

As noted above, when the key 130 is inserted into the cartridge 200, the engagement surfaces 233 travel along the edge cut 136. When the shank 131 is fully inserted, the position of each blocking member 230 corresponds to the root depth of the bitting feature 137 with which the blocking member 230 is engaged. As the key 130 is rotated, engagement between the cam surfaces 213, 243 urges each cam plate 240 toward the corresponding stop plate 220. If the proper key 130 has been inserted, each blocking member 230 is in the unblocked position, and each of the interference protrusions 235 is aligned with a corresponding recess 245. In such a case, each cam plate 240 is free to move toward the corresponding stop plate 220, and further rotation of the key 130 is not prevented. If one or more of the blocking members 230 are in the blocked position, the interference protrusion 235 of that blocking member 230 prevents further longitudinal movement of the corresponding cam plate 240.

With the cam plate 240 blocked from further longitudinal movement, interference between the cam surfaces 213, 243 prevents further rotation of the cam plate 240 and the key 130.

It should be appreciated that various features of the cartridge 200 may be selected such that the blocking member 230 moves to the unblocking position when engaged with a predetermined form of bitting feature 137. For example, the positions of the interference protrusion 235 and/or the recess 245 may be selected to correspond to an edge-cut bitting feature 137 of a particular root depth. In certain forms, the cartridge 200 may be labeled with a code corresponding to the root depth (or depths if the cartridge 200 includes multiple recesses 245) of a bitting feature 137 which will cause the interference protrusion 235 to align with the recess 245. Given the bitting code of a particular key 130, a user can easily select and install the cartridges 200, which will in turn enable the cylinder 100 to be operated by the key 130.

While the plug 120 is illustrated with the above-described cartridges 200, the cartridges 140 which form the plug 120 may take a variety of other forms and configuration, such as those described below. In certain forms, each of the cartridges 140 may include a first blocking member which engages the edge cut 136, and a second blocking member which engages the side milling 138. Because the cartridges 140 are interchangeable and self-contained, they may be used across a variety of cylinder formats by selecting an appropriate configuration of the shell 110.

FIGS. 6-11 depict cartridges including blocking members according to other embodiments. Each of the cartridges is substantially similar to the cartridge 200. Unless indicated otherwise, similar reference characters are used to indicate similar elements and features. In the interest of conciseness, the following descriptions focus primarily on features that are different than those described above with regard to the cartridge 200. Additionally, while certain features of the cartridges may be omitted from some of the figures, it is to be appreciated that those features may be present in some or all of the cartridges.

Figure 6:
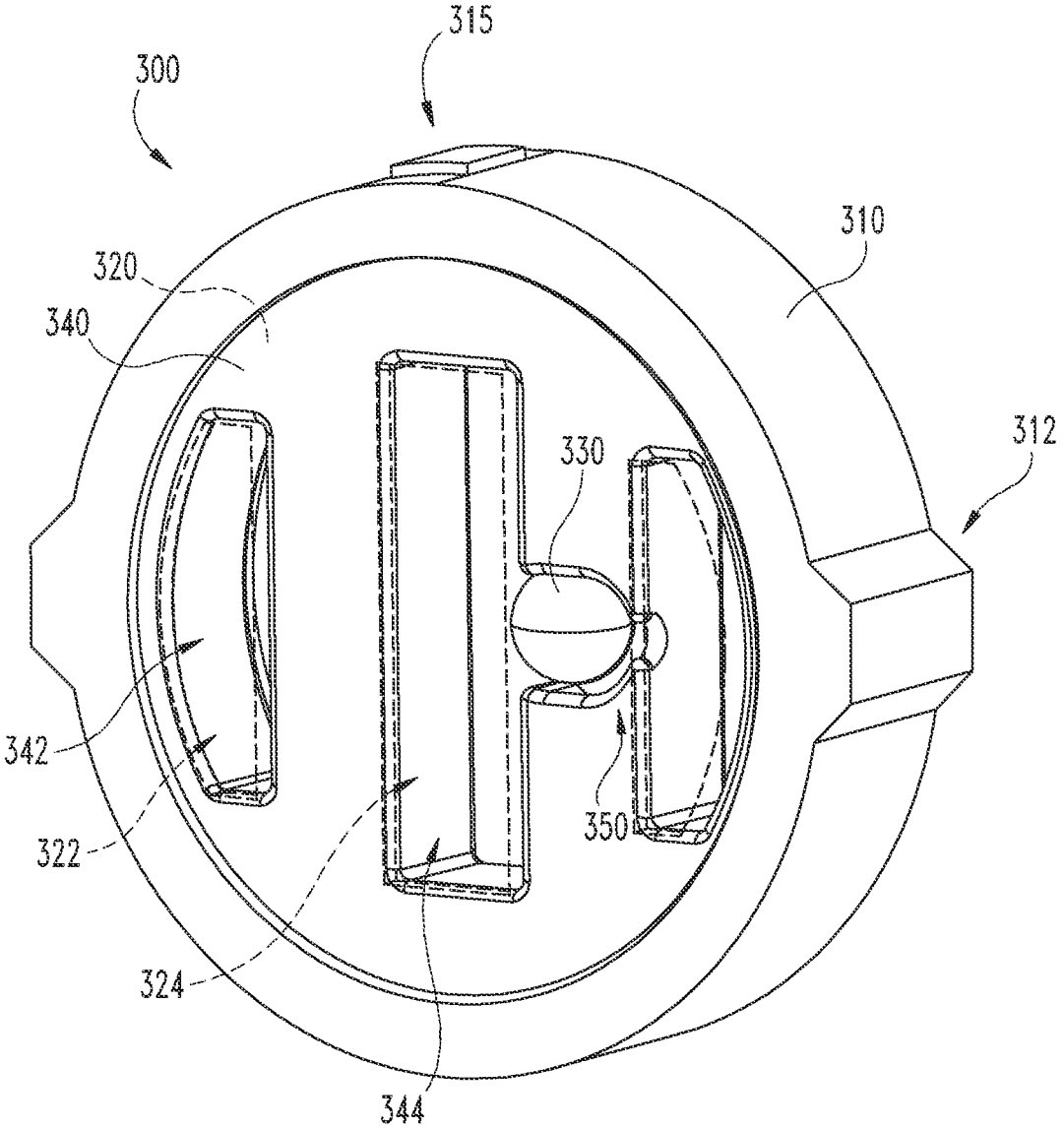
FIG. 6 is a perspective illustration of a cartridge according to another embodiment.
Figure 7:
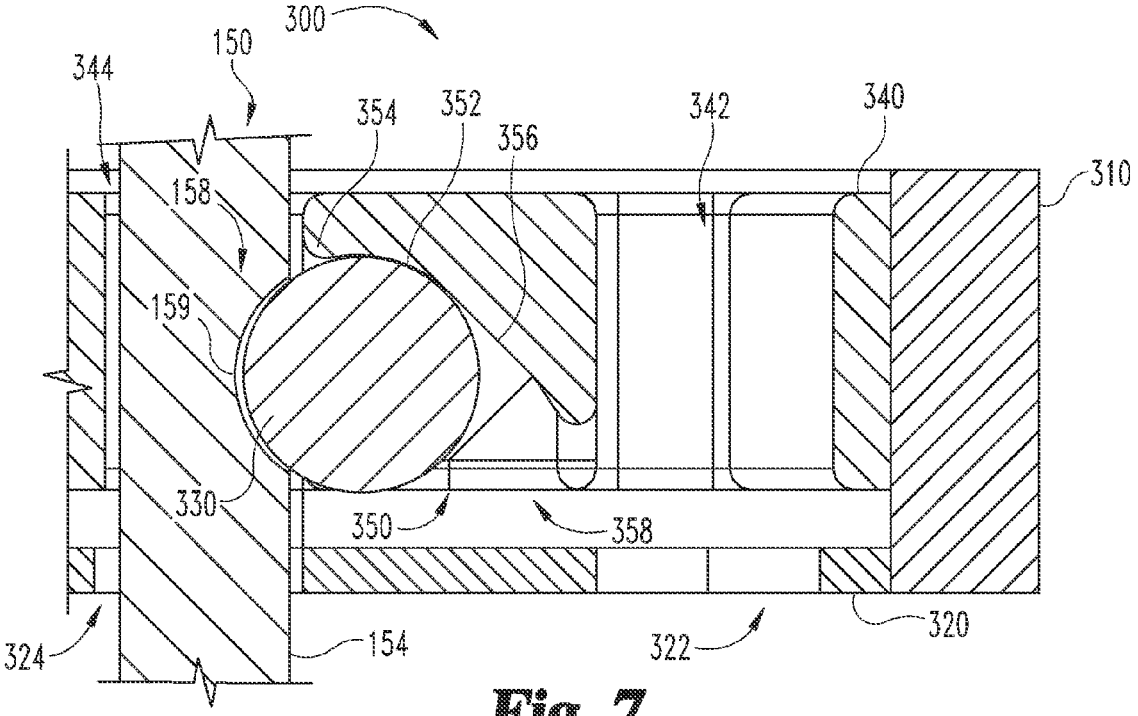
FIG. 7 is a cross-sectional illustration of the cartridge illustrated in FIG. 6 in an unblocked state.
Figure 8:
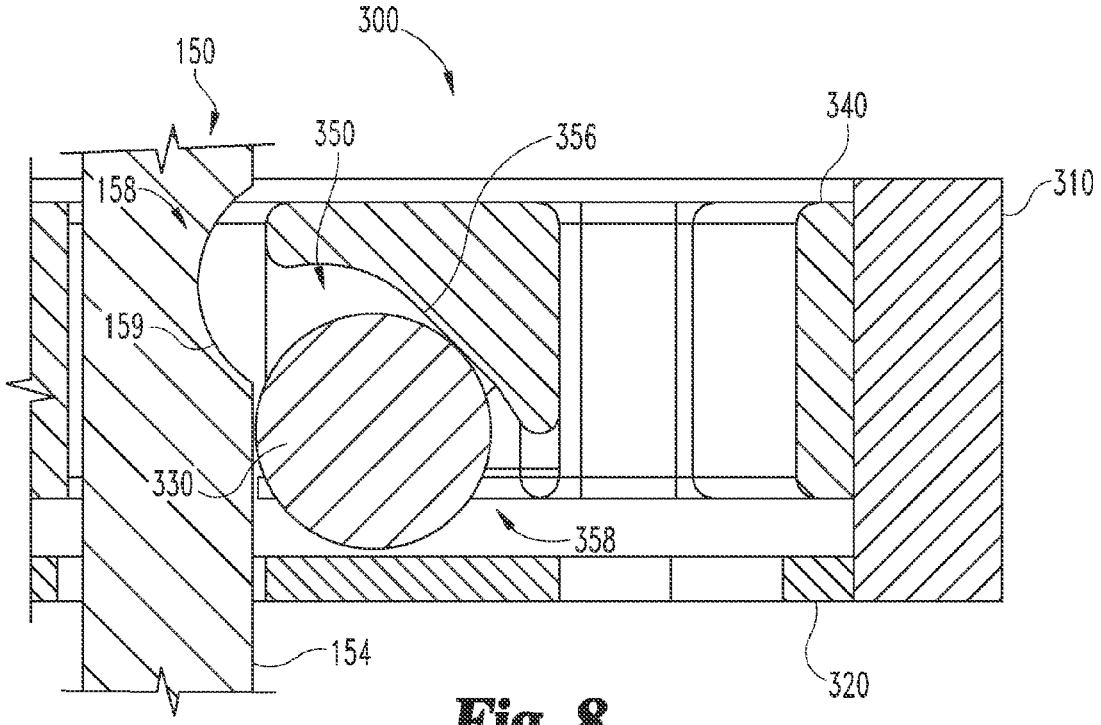
FIG. 8 is a cross-sectional illustration of the cartridge illustrated in FIG. 6 in a blocked state.

With reference to FIGS. 6-8, a cartridge 300 according to another embodiment includes a substantially spherical blocking member 330 seated in a cavity 350. As best seen in FIG. 7, the cavity 350 is formed in the cam plate 340, and is defined in part by a seat 352, a lip 354, and a ramp 356 which extends from the seat 352 toward the stop plate 320. In other embodiments, the cavity 350 may be formed in the stop plate 320. The cavity 350 includes an opening 358 through which a portion of the blocking member 330 protrudes when in the blocking position.

When in the unblocking position (FIG. 7), the blocking member 330 is positioned in the seat 352, and the lip 354 prevents the blocking member 330 from falling out of the cavity 350 and into the passage 342. The blocking member 330 may be biased toward the unblocking position such as, for example, by a biasing member (not illustrated) or by gravity and the geometry of the cavity 350. FIG. 7 also depicts a key 150 which has a cut 158 formed in the side surface 154. The cut 158 includes a plurality of bitting features in the form of dimples 159 (one illustrated) which are dispersed along the side surface 154. When the key 150 is inserted, the blocking member 330 becomes seated in the dimple 159 and does not significantly protrude through the opening 358. As such, the cam plate 340 is free to move toward the stop plate 320 as the plates 320, 340 are rotated, thereby defining an unblocked state of the cartridge.

With specific reference to FIG. 8, if the dimple 159 is not aligned with the blocking member 330 (or if the key 150 does not include an appropriate cut 158), the side surface 154 urges the blocking member 330 laterally away from the key 150 and into engagement with the ramp 356. As the key 150 moves the blocking member 330 laterally, the ramp 356 urges the blocking member 330 longitudinally toward the stop plate 320 and into the blocking position. If the key 150 is then rotated, the blocking member 330 becomes trapped between the key 150, the stop plate 320, and the ramp 356, thereby preventing further longitudinal movement of the cam plate 340. With the cam plate 340 blocked from further longitudinal movement, the plates 320, 340 are unable to rotate, thereby defining a blocked state of the cartridge 300.

Various features of the cartridge 300 may be selected such that the blocking member 330 moves to the unblocking position when engaged with a predetermined form of the dimple 159. For example, the diameter of the blocking member 330 may be selected to conform to dimples 159 of a predetermined depth. Additionally or in the alternative, the transverse position of the cavity 350 may be may be selected such that the blocking member 330 engages only dimples 159 formed at a corresponding location on the key 150.

While the illustrated blocking member 330 is configured as a ball or sphere, it is also contemplated that a laterally-movable blocking member may have a non-spherical shape or configuration. For example, a blocking member may be configured as a pin that is laterally slidable along a channel formed in one of the plates 320, 340, and the other of the plates 320, 340 may include an interference protrusion aligned with the channel. In such embodiments, the pin may be aligned with the interference protrusion when in a blocking position, thereby preventing the protrusion from entering the channel and blocking longitudinal movement of the cam plate 340. When engaged with an appropriate bitting feature, the pin may move out of alignment with the interference protrusion wherein the cam plate 340 is free to move toward the stop plate 320.

Figure 9:
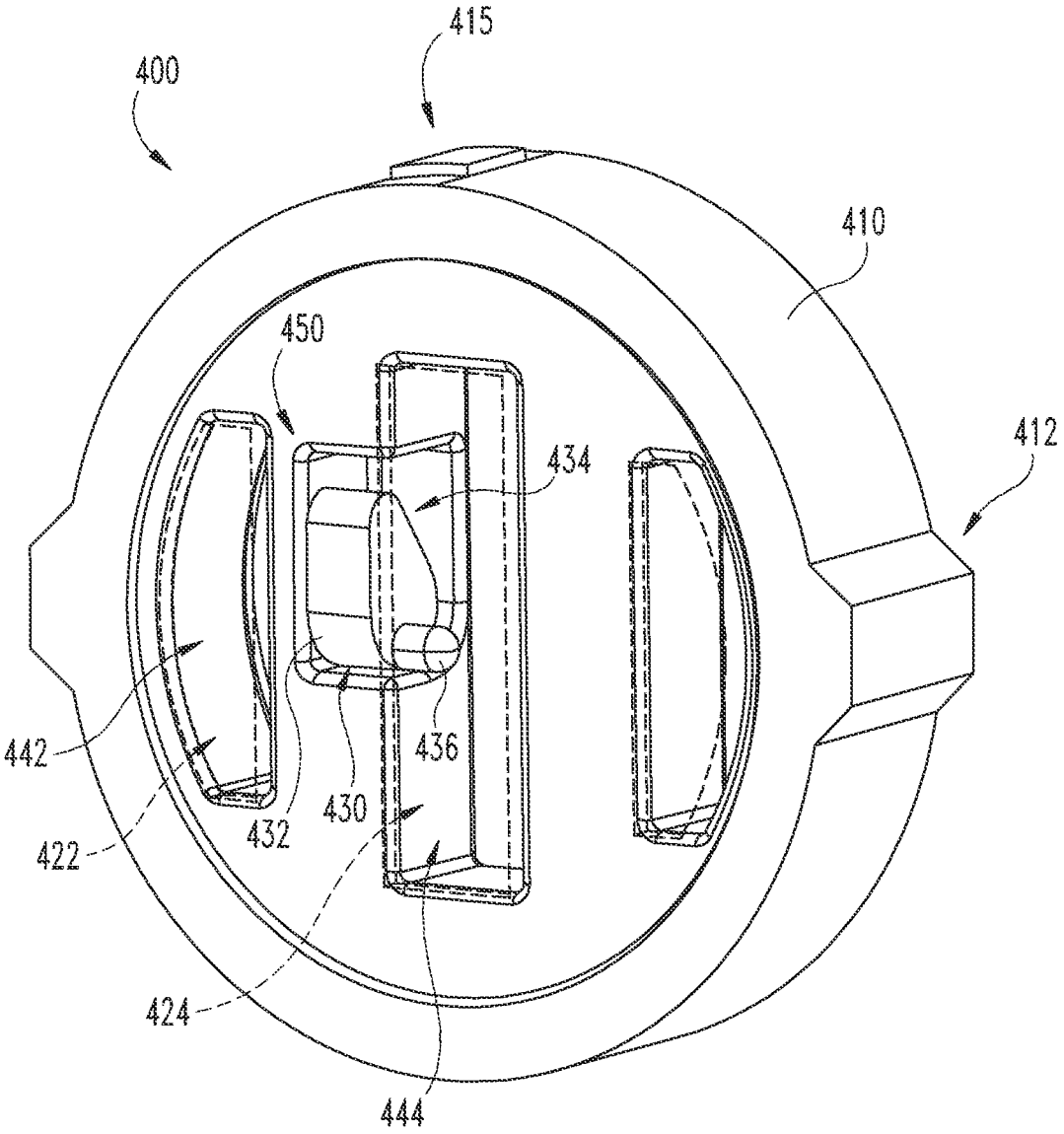
FIG. 9 is a perspective illustration of a cartridge according to another embodiment.
Figure 10:
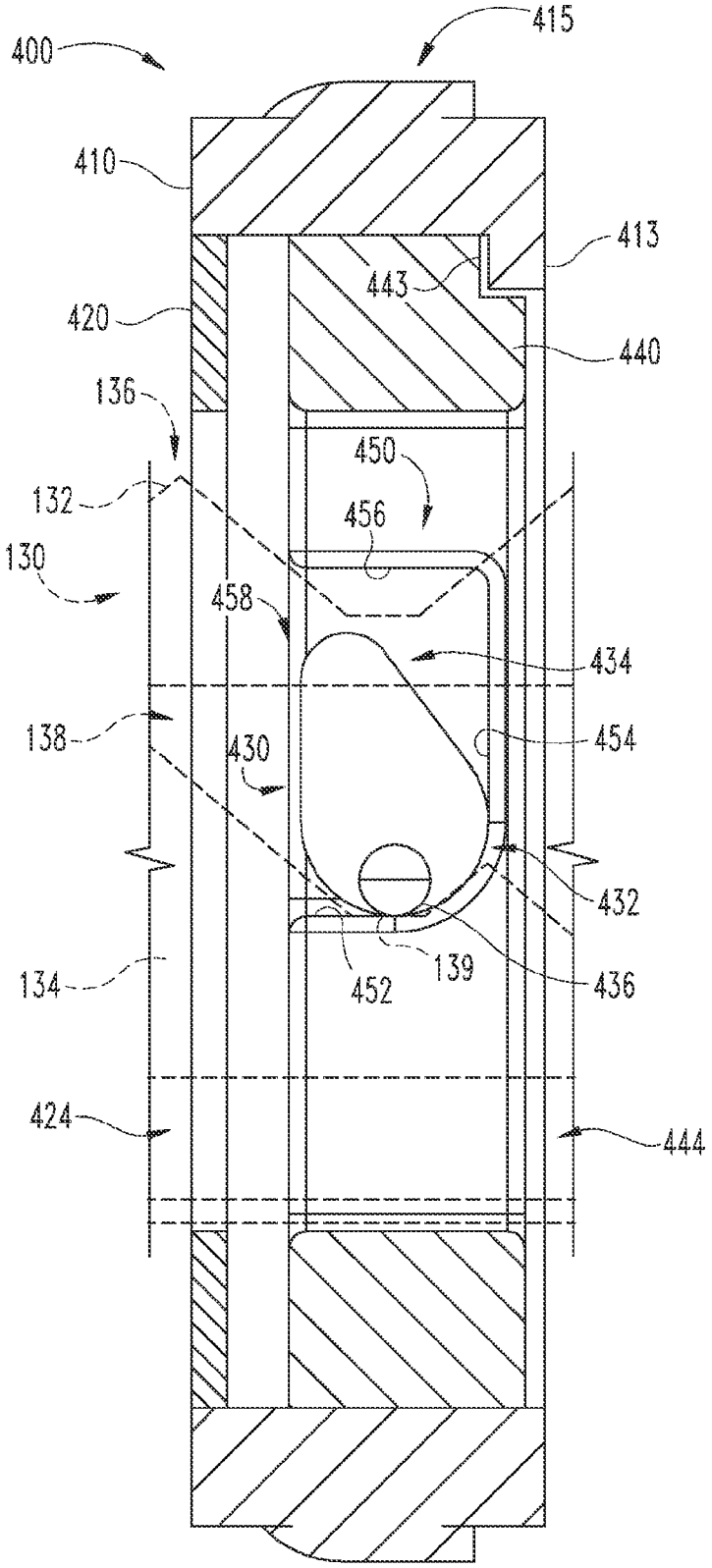
FIG. 10 is a cross-sectional illustration of the cartridge illustrated in FIG. 9 in an unblocked state.
Figure 11:
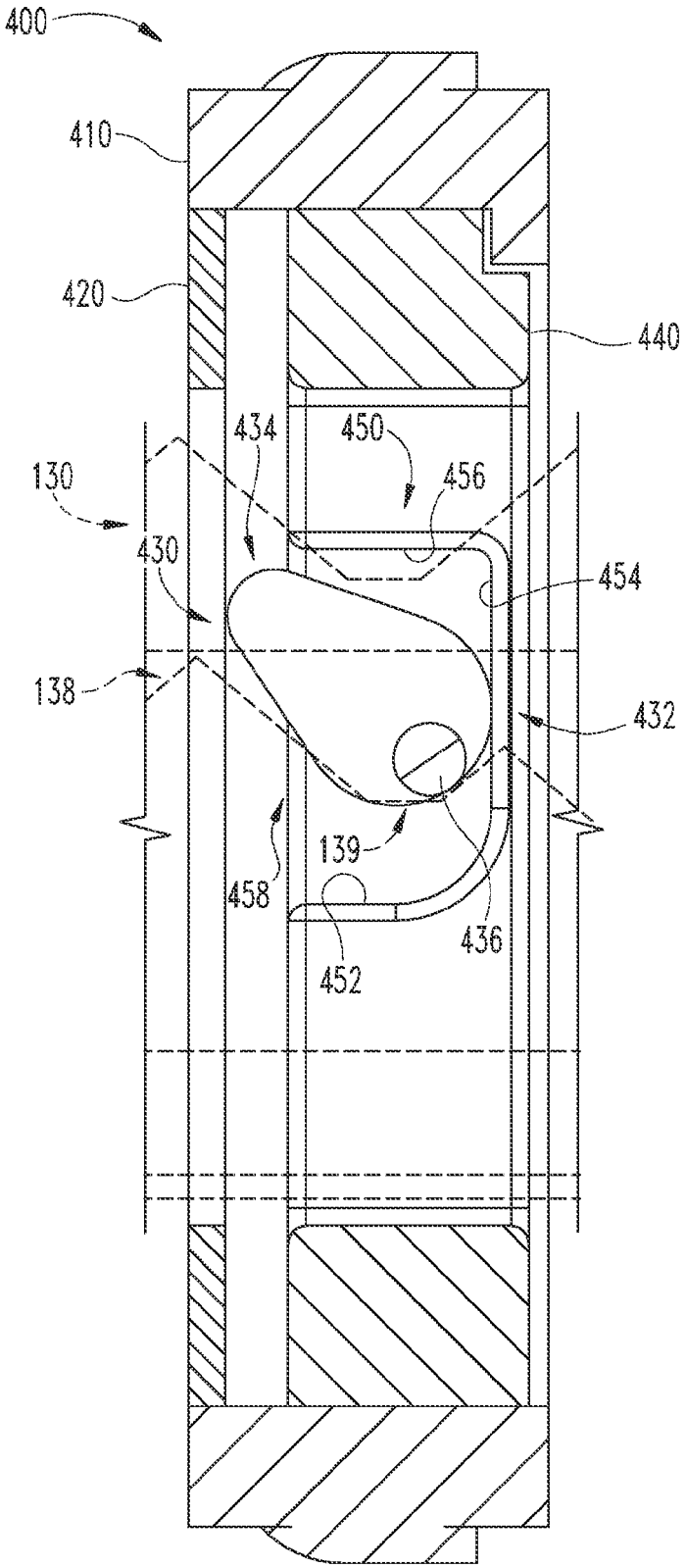
FIG. 11 is a cross-sectional illustration of the cartridge illustrated in FIG. 9 in a blocked state.

With reference to FIGS. 9-11, a cartridge 400 according to another embodiment includes an oblong blocking member 430 seated in a cavity 450. The blocking member 430 comprises a body portion 431 including a wide end 432, a narrow end 434, and a peg 436 formed at the wide end 432. The peg 436 extends laterally into the passage 442 and is configured to engage the side-milling 138 formed on the side surface 134 of the key 130. The peg 436 may also provide a warding feature by preventing insertion of a key which does not include a side-milling 138 or a channel formed in the side surface 134.

As best seen in FIG. 10, the cavity 450 is formed in the cam plate 440, and is defined in part by a base 452 and a ceiling 456 which extend from a wall 454 toward the stop plate 420. The cavity 450 may be further defined by a lip (not illustrated) which prevents the blocking member 430 from falling out of the cavity 450 and into the passage 442. The cavity 450 includes an opening 458 through which a portion of the blocking member 430 protrudes when in the blocking position.

In the illustrated form, the bitting feature 139 which corresponds to the cartridge 400 has such a root depth that it does not engage the peg 436. As such, when the key 130 is inserted, the wide end 432 may rest on the base 452. In other forms, the bitting feature 139 may be configured to engage the peg 436, in which case the blocking member 430 need not be in contact with the base 452. When the proper key 130 is inserted, the blocking member 430 is in an unblocking position (FIG. 10). In the illustrated unblocking position, the narrow end 434 does not significantly protrude through the opening 458. As such, the cam plate 440 is free to move toward the stop plate 420 as the plates 420, 440 are rotated, thereby defining an unblocked state of the cartridge 400. In some circumstances, the narrow end 434 may protrude through the opening 458. In such a case, the blocking member 430 may remain free to pivot, and the stop plate 420 may urge the narrow end 434 into the cavity 450 as the cam plate 440 approaches the stop plate 420.

With specific reference to FIG. 11, if the bitting feature 139 does not have the appropriate root depth, the bitting feature 139 engages the peg 436. As a result, the blocking member 430 pivots to a blocking position in which the narrow end 434 protrudes through the opening 458 toward the stop plate 420. If the key 130 is then rotated, the cam plate 440 moves toward the stop plate 420 and the blocking member 430 becomes trapped between the key 130, the stop plate 420, and the wall 454. In this blocking position, the blocking member 430 prevents further longitudinal movement of the cam plate 440. With the cam plate 440 blocked from further longitudinal movement, interference between the cam surfaces prevents the plates 420, 440 from rotating, thereby defining a blocked state of the cartridge 400.

Various features of the cartridge 400 may be selected such that the blocking member 430 moves to the unblocking position when engaged with a predetermined form of the bitting feature 139. For example, the position of the peg 436 on the body 431 and the transverse position of the cavity 450 may be selected to correspond to a side-milled bitting feature 139 of a particular root depth. In other embodiments, the peg 436 may instead be configured to engage the edge cut 136.

Figure 12:
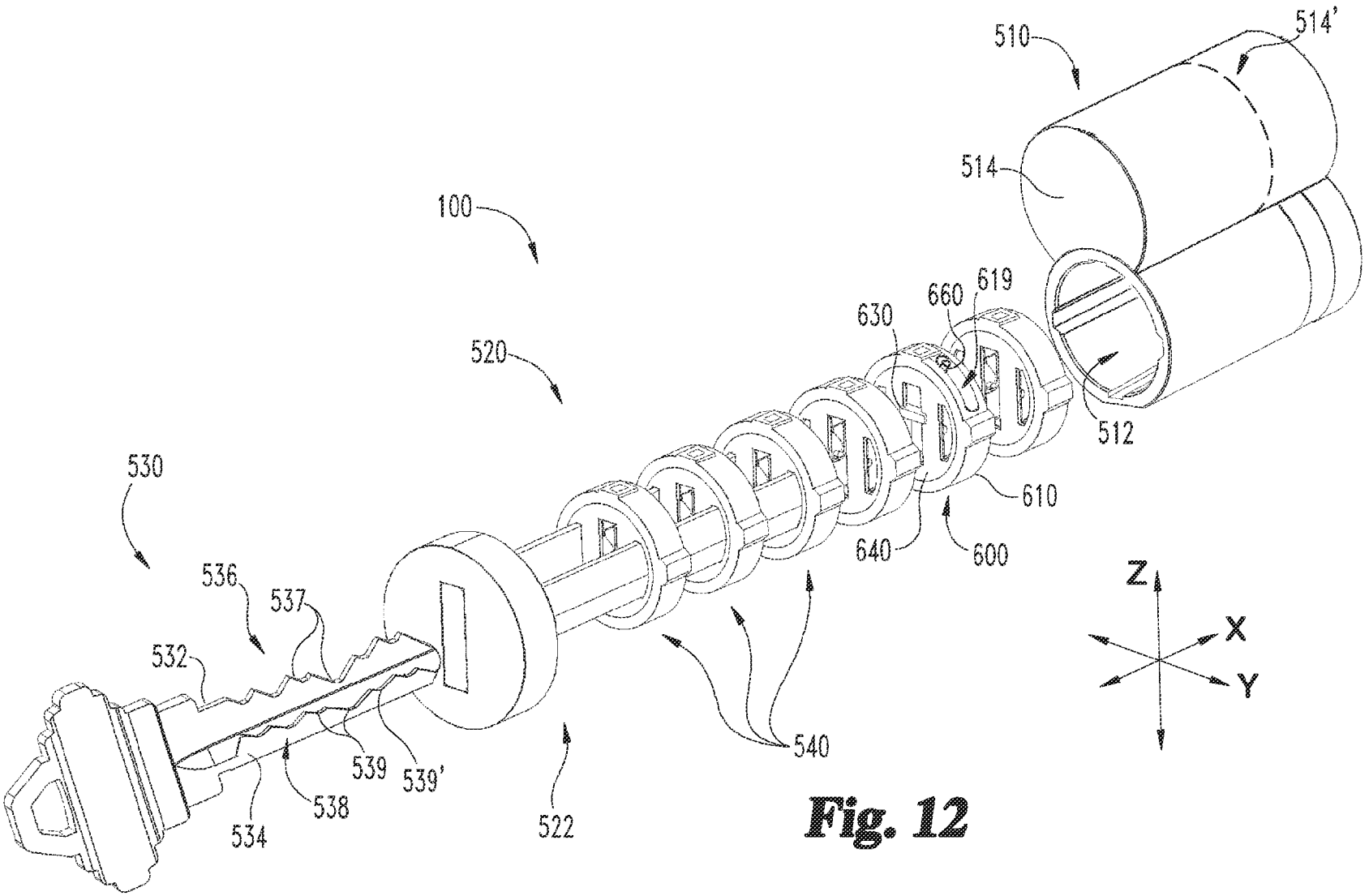
FIG. 12 is an exploded assembly view of a lock cylinder according to another embodiment.
Figure 13:
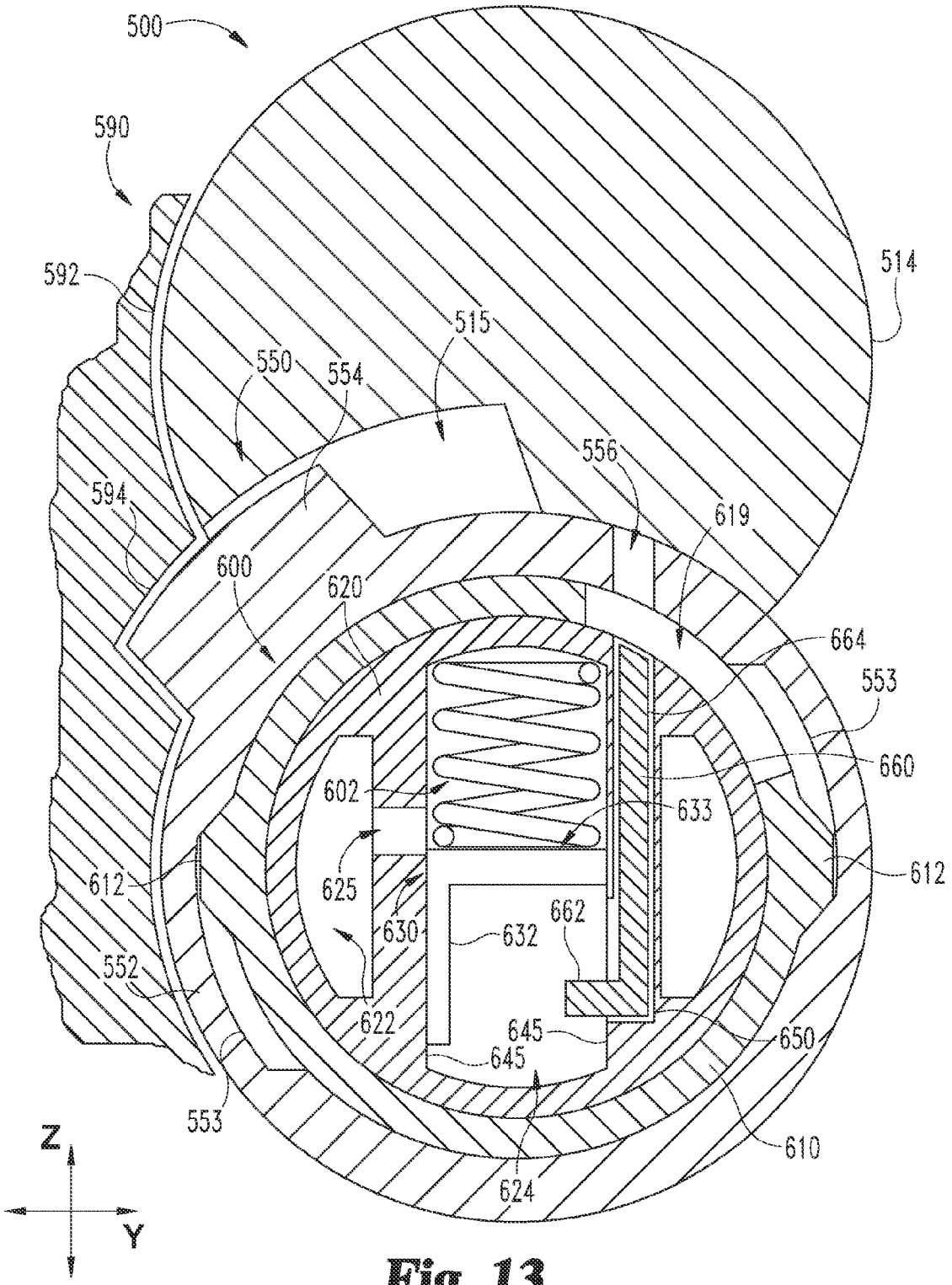
FIG. 13 is a cross-sectional illustration of the lock cylinder illustrated in FIG. 12 in a holding state.
Figure 14:
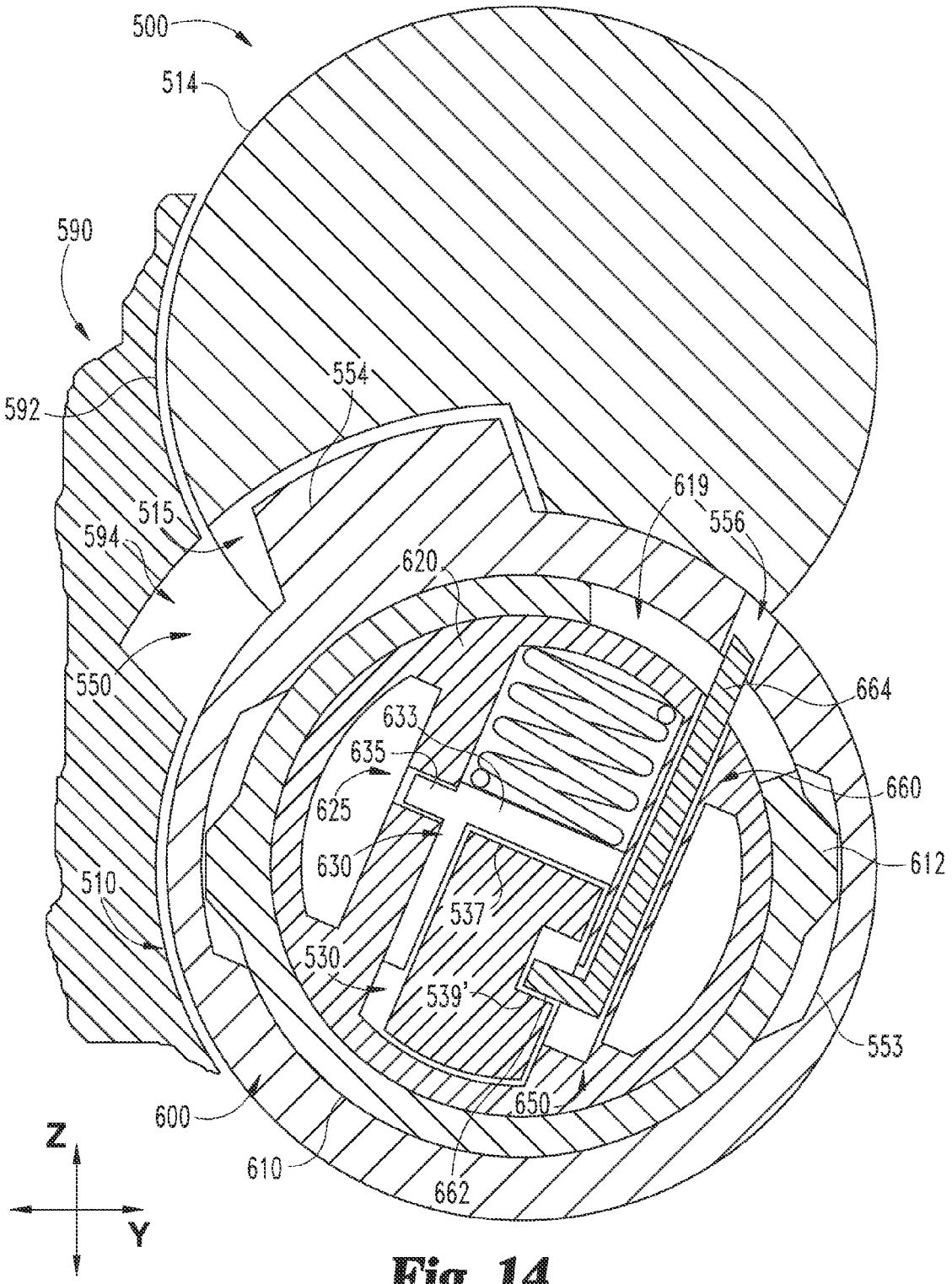
FIG. 14 is a cross-sectional illustration of the lock cylinder illustrated in FIG. 12 in a releasing state.

FIGS. 12-14 depict a lock cylinder 500 and a cartridge 600 according to another embodiment. The lock cylinder 500 and the cartridge 600 are substantially similar to the lock cylinder 100 and the cartridge 200, respectively. Unless indicated otherwise, similar reference characters are used to indicate similar elements and features. In the interest of conciseness, the following descriptions focus primarily on features that are different than those described above with regard to the lock cylinder 100 and the cartridge 200.

With reference to FIGS. 12-14, the lock cylinder 500 generally includes a shell 510 and a plug 520, and the lock cylinder 500 is operable by a key 530. The plug 520 comprises a plurality of cartridges 540 stacked on a plug body 522. Each of the cartridges 540 is a multi-function cartridge configured to engage two or more cuts on the key 530. The cartridges 540 may, for example, be configured in a similar manner as the cartridges 200, 300, 400 described in detail above. One or more of the cartridges 540 may include a plurality of blocking members. The cylinder 500 further comprises a control ring 550 rotatably mounted on the shell 510. Additionally, one of the cartridges 540 is a control cartridge 600 that is aligned with the control ring 550 when the plug 520 is seated in the chamber 512.

The control ring 550 generally includes an annular portion 552 and a control lug 554 which extends radially outward from the annular portion 552. The annular portion 552 may include a pair of channels 553 which receive the ridges 612. Each of the channels 553 extends about a portion of the inner circumference of the annular portion 552 such that the control ring 550 can be rotated about the control cartridge 600. The longitudinal width (in the illustrated X-direction) of the annular portion 552 may be less than that of the housing 610 such that the proximal and distal ends of the ridges 612 remain engaged with the groove 513. In certain embodiments, the annular portion 552 need not define a complete circle, and may be configured to only partially surround the control cartridge 600.

While other forms are contemplated, the illustrated lock cylinder 500 is a small format interchangeable core (SFIC) cylinder including an SFIC tower 514. The tower 514 includes a slot 515 sized and configured to receive the control lug 554. As shown in FIGS. 13 and 14, the cylinder 500 is configured for mounting in an SFIC housing 590 which includes a chamber 592 configured to receive the shell 510, and a slot 594 aligned with the tower slot 515. While only a portion of the SFIC housing 590 is illustrated, it should be appreciated that the chamber 592 circumferentially surrounds the shell 510 and has a geometry corresponding to that of the shell 510.

When the cylinder 500 is installed in the housing 590, the control ring 550 is operable to selectively retain the cylinder 500 in the housing 590. As described in further detail below, the control ring 550 is rotatable among a holding position and a releasing position, and the control cartridge 600 is operable to rotate the control ring 550 upon insertion of a proper key 530. In the holding position (FIG. 13), the control lug 554 is positioned at least partially in the housing slot 594, thereby preventing longitudinal movement of the cylinder 500 within the housing 590. In the releasing position (FIG. 14), the control lug 554 is positioned in the tower slot 515 and does not prevent longitudinal movement of the cylinder 500.

While the illustrated tower 514 includes a slot 515 which receives the control lug 554 when the control ring 550 is in the releasing position, other forms are also contemplated. For example, the tower 514 may be longitudinally shortened, as depicted by the phantom tower 514'. In either case, a portion of the control lug 554 is not aligned with the tower 514 in the holding position such that the control lug 554 is positioned at least partially in the housing slot 594. In the releasing position, the portion is aligned with the tower 514, and is not positioned in the housing slot 594.

The control cartridge 600 includes a control pin 660 and may also include a blocking member 630. While the illustrated blocking member 630 is configured substantially similar to the above-described blocking member 230, it is also contemplated that the blocking member 630 may be of another form such as, for example, those described above with reference to FIGS. 6-11. The illustrated control pin 660 is seated in a cavity 650 formed in the stop plate 620. The control pin 660 includes an arm 662 extending into the passage 624, and a tip 664 extending toward a slot 619 formed in the cartridge housing 610. The control ring 550 includes an opening 556 aligned with and configured to receive the tip 664.

When a proper key 530 is inserted, each of the cartridges 540 transitions from the blocked state to the unblocked state, thereby enabling rotation of the key 530. In the illustrated form, the key 530 is a control key, and one of the side-milled bitting features 539 is a control bitting 539'. When the key 530 is inserted, the control bitting 539' engages the arm 662, thereby urging the tip 664 into the opening 556. Additionally, one of the edge-cut bittings 537 engages the blocking member 630, thereby moving the interference protrusion 635 into alignment with a recess 625 formed in the stop plate 620. If the key 530 is subsequently rotated, the control pin 660 causes the control ring 550 to rotate from the holding position (FIG. 13) to the releasing position (FIG. 14). During rotation of the key 530, the control ring channels 533 travel along the ridges 612, and the control pin 660 travels along the housing channel 519.

It is to be appreciated that if the key 530 does not include a control bitting 539' of the appropriate configuration, the key 530 may still operate the lock cylinder 500 in a normal fashion. In other words, if a key includes the appropriate cuts 536, 538, but the bitting feature 539 corresponding to the control cartridge 600 is not capable of moving the tip 664 into the opening 556, such a key may still be capable of transitioning the cylinder 500 between its locked and unlocked states.

In the illustrated control cartridge 600, the blocking member 630 is configured to engage the edge cut 536, and the control pin 660 configured to engage a side-milling 538. It is also contemplated that the control pin 660 may instead be configured to engage another form of cut, such as the edge cut 536. In such forms, the blocking member 630 may be configured to engage the side-milling 538 or a dimple cut. In certain embodiments, the control cartridge 600 need not include a blocking member.

Figure 15:
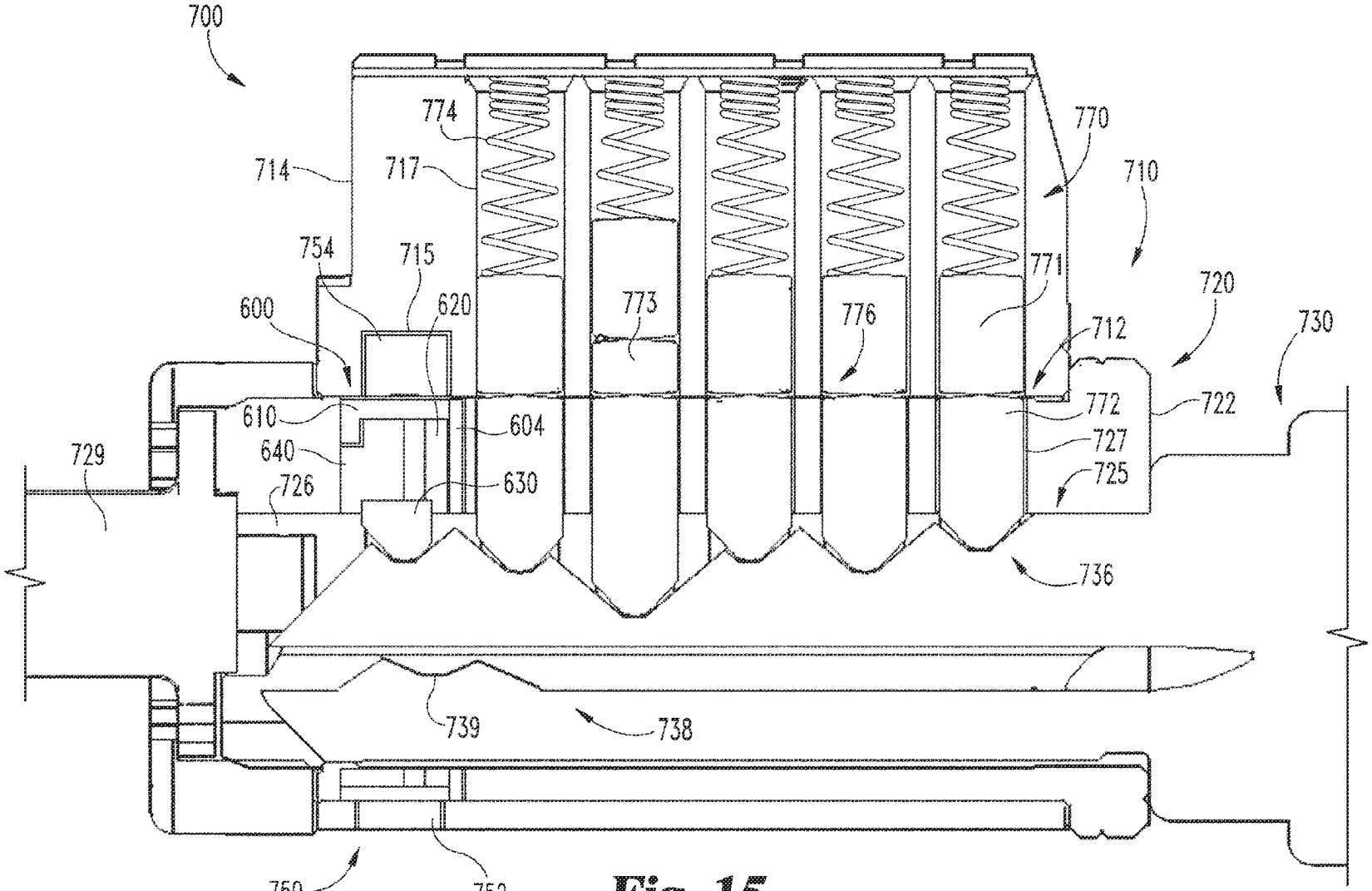
FIG. 15 is a cross-sectional illustration of a lock cylinder according to another embodiment.

With reference to FIG. 15, a lock cylinder 700 according to another embodiment generally comprises a shell 710, a plug 720, and a control ring 750, and the lock cylinder 700 is operable by a key 730. The cylinder 700 also includes a tumbler set 770 which generally comprises a plurality of driving pins 771, a plurality of driven pins 772, and may further comprise one or more master pins 773. While the illustrated tumbler set 770 is illustrated and described as a pin tumbler set, it is also contemplated that other forms of tumblers, such as disc tumblers and wafer tumblers, may be utilized.

The shell 710 includes a tower 714 which defines a slot 715 configured to receive the control lug 754 of the control ring 750, and a plurality of shell tumbler shafts 717 configured to receive the driving pins 771. The cylinder 700 also includes a plurality of springs 774 which are seated in the shell tumbler shafts 717 and bias the driving pins 771 toward the plug 720.

The illustrated plug 720 includes a body 722 having a pair of posts 726 which extend from the distal end of the body 722 and engage a tailpiece 729. The plug body 722 defines a plurality of plug tumbler shafts 727 configured to receive the driven pins 772. When the proper key 730 is inserted, the driving pins 771 are positioned in the shell tumbler shafts 717, and the driven pins 772 are positioned in the plug tumbler shafts 727. In this state, interfaces between the pins are aligned with a shear line 776 defined between the plug body 722 and the shell 710, and the tumbler set 770 does not prevent rotation of the plug 720 with respect to the shell 710.

The plug 720 also includes the above-described control cartridge 600 mounted on the posts 726 such that the plates 620, 640 are rotationally coupled to the plug body 722. Thus, when the control cartridge 600 is in the blocked state, rotation of the key 730 is prevented. Additionally, when the key 730 includes an appropriate bitting feature 739, the control pin 660 (not visible) engages the control ring 750, enabling rotation of the control lug 754 in the manner described above.

Figure 16:
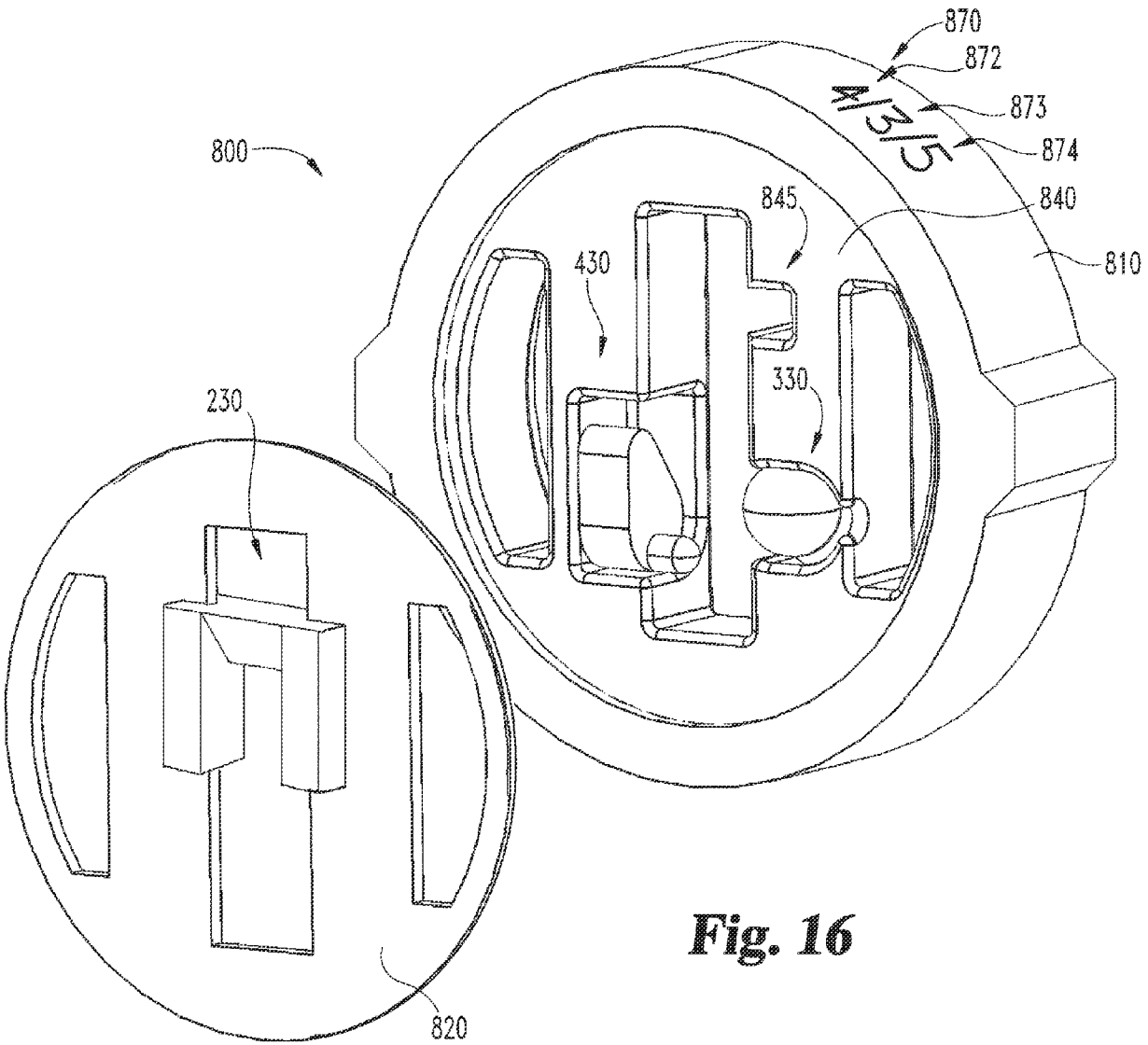
FIG. 16 is a perspective illustration of a cartridge according to another embodiment.

With reference to FIG. 16, a cartridge 800 according to another embodiment includes the transversely sliding blocking member 230, the laterally movable blocking member 330, and the pivoting blocking member 430. The cartridge 800 may further comprise bitting indicia 870 which relate to the blocking members 230, 330, 430. For example, a first indicium 872 may relate to the root depth of an edge-cut bitting feature which will move the transversely sliding blocking member 230 to its unblocking position. A second indicium 873 may relate to the lateral depth of a dimple bitting feature which will move the laterally movable blocking member 330 to its unblocking position. A third indicium 874 may relate to the root depth of a side-milled bitting feature which will move the pivoting blocking member 430 to its unblocking position. In other embodiments, the cartridge 800 may include a control pin in place of one of the blocking members 230, 330, 430, and the indicia 870 may include an indicium relating to a bitting feature which will cause the control pin to engage a control ring.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a cartridge comprising:

a housing having a non-circular outer perimeter;

first and second plates rotatably mounted in the housing;

a cam interface configured to urge the first plate longitudinally toward the second plate in response to rotation of the first plate in a first rotational direction;

a passage extending longitudinally through the first plate and the second plate, wherein the passage is configured to receive a key comprising a first cut including a plurality of first bitting features and a second cut comprising a plurality of second bitting features;

a blocking member having a blocking position in which the blocking member blocks the first plate from moving toward the second plate, and an unblocking position in which the blocking member does not block the first plate from moving toward the second plate, wherein the blocking member is configured to engage the first cut and to move to the unblocking position in response to engagement with one of the first bitting features; and a movable member having a first position and a second position, wherein the movable member is configured to engage the second cut, and to move to the second position in response to engagement with one of the second bitting features; and wherein, with the second plate blocked from moving toward the first plate, the cam interface prevents rotation of the first plate in the first rotational direction.

2. The apparatus of claim 1, further comprising a plug including the cartridge.

3. The apparatus of claim 2, wherein the plug comprises a plurality of the cartridges.

4. The apparatus of claim 3, wherein, in at least one of the cartridges, the movable member blocks the first plate from moving toward the second plate when in the first position and does not block the first plate from moving toward the second plate when in the second position.

5. The apparatus of claim 2, further comprising a shell including a chamber;

wherein the plug further comprises a plug body rotationally coupled with the first and second plates; and wherein the plug is seated in the chamber, and the housing is rotationally coupled to the shell.

6. The apparatus of claim 5, further comprising a control ring aligned with the cartridge, the control ring including a control lug and an opening aligned with the movable member, wherein the control ring is rotatable with respect to the shell;

wherein the shell comprises a shell body defining the chamber, and a tower extending from the shell body; and wherein, in the second position, the movable member extends into the opening and is operable to rotate the control ring among a holding position in which a portion of the control lug is not aligned with the tower, and a releasing position in which the portion is aligned with the tower.

7. The apparatus of claim 6, further comprising a tumbler set configured to engage the first cut and to selectively prevent rotation of the plug body with respect to the shell.

8. The apparatus of claim 7, wherein the tumbler set comprises a plurality of driving pins seated in the shell, a plurality of driven pins seated in the plug body, and a plurality of biasing members urging the driving pins into engagement with the driven pins.

9. The apparatus of claim 6, wherein the tower comprises a slot configured to receive the control lug;

wherein, in the holding position, the portion is not received in the slot; and wherein, in the releasing position, the portion is received in the slot.

10. The apparatus of claim 1, wherein the housing comprises a slot;

wherein the movable member comprises a control pin;

wherein, in the first position, the control pin is aligned with the slot; and wherein, in the second position, the control pin extends through the slot.

11. The apparatus of claim 1, wherein the cartridge further comprises indicia relating to the one of the first bitting features and the one of the second bitting features.

12. The apparatus of claim 1, wherein the cartridge further comprises a second of the blocking members, wherein the second blocking member is configured to engage a third cut of the key.

13. An apparatus, comprising:

a housing configured for mounting in a shell of a lock cylinder, the housing having a non-circular outer perimeter;

a first plate rotatably mounted in the housing;

a second plate rotatably mounted in the housing;

a passage extending longitudinally through the first plate and the second plate;

a cam interface configured to urge the first plate longitudinally toward the second plate in response to rotation of the first plate in a first rotational direction;

a blocking member configured to move among a blocking position and an unblocking position in response to engagement with a cut of a key;

wherein, with the blocking member in the blocking position, the first plate is blocked from moving toward the second plate, and the cam interface prevents the first plate from rotating in the first rotational direction; and wherein, with the blocking member in the unblocking position, the first plate is not blocked from moving toward the second plate, and the first plate is not prevented from rotating in the first rotational direction.

14. The apparatus of claim 13, further comprising a cavity formed in one of the first plate and the second plate, and wherein the blocking member is seated in the cavity.

15. The apparatus of claim 13, wherein one of the plates includes a cavity in communication with the passage, and the blocking member is positioned at least partially in the cavity.

16. The apparatus of claim 15, wherein the cavity is defined in part by a ramp extending toward the other of the plates.

17. The apparatus of claim 16, wherein the blocking member comprises a ball.

18. The apparatus of claim 16, wherein the blocking member comprises a body seated in the cavity and a post extending into the passage, wherein the blocking member is configured to pivot among the blocking and unblocking positions.

19. A lock cylinder, comprising:

a shell including a shell body defining a chamber;

a plug seated in the chamber, the plug comprising a plurality of cartridges, each of the plurality of cartridges comprising:

a housing rotationally coupled with the shell and comprising a first cam surface;

a first plate rotatably mounted in the housing and comprising a first passage;

a second plate rotatably mounted in the housing and comprising a passage aligned with the first passage, and a second cam surface engaged with the first cam surface, wherein engagement between the first and second cam surfaces is configured to urge the second plate longitudinally toward the first plate in response to rotation of the second plate in a first rotational direction;

a first blocking member and a second blocking member, each blocking member having a blocking position in which it blocks the second plate from moving toward the first plate, and an unblocking position in which it does not block the second plate from moving toward the first plate;

wherein, with the second plate blocked from moving toward the first plate, interference between the first and second cam surfaces prevents rotation of the second plate in the first rotational direction;

wherein each of the first blocking members is configured to move to the unblocking position in response to engagement with a first cut of a key; and wherein each of the second blocking members is configured to move to the unblocking position in response to engagement with a second cut of the key.

20. The lock cylinder of claim 19, wherein each first plate and each second plate further comprises an opening, and wherein the plug further comprises a plug body including a post extending longitudinally through the openings in the first and second plates.

* * * * *